US011201433B2

(12) United States Patent
Tanikawa

(10) Patent No.: US 11,201,433 B2
(45) Date of Patent: Dec. 14, 2021

(54) LEVER-TYPE CONNECTOR

(71) Applicant: Sumitomo Wiring Systems, Ltd., Mie (JP)

(72) Inventor: Naotaka Tanikawa, Mie (JP)

(73) Assignee: Sumitomo Wiring Systems, Ltd.

( * ) Notice: Subject to any disclaimer, the term of this patent is extended or adjusted under 35 U.S.C. 154(b) by 29 days.

(21) Appl. No.: 16/807,389

(22) Filed: Mar. 3, 2020

(65) Prior Publication Data

US 2020/0287321 A1 Sep. 10, 2020

(30) Foreign Application Priority Data

Mar. 5, 2019 (JP) ..... JP2019-039491

(51) Int. Cl.
*H01R 13/58* (2006.01)
*H01R 13/629* (2006.01)

(52) U.S. Cl.
CPC ... *H01R 13/5804* (2013.01); *H01R 13/62938* (2013.01); *H01R 13/62955* (2013.01); *H01R 13/62977* (2013.01)

(58) Field of Classification Search
CPC ..... H01R 13/5804; H01R 13/62938; H01R 13/62977; H01R 13/5812; H01R 13/62955
See application file for complete search history.

(56) References Cited

U.S. PATENT DOCUMENTS

| | | | | |
|---|---|---|---|---|
| 7,179,132 | B2 * | 2/2007 | Flowers | H01R 13/4364 439/686 |
| 7,234,952 | B2 * | 6/2007 | Sasaki | H01R 13/6295 439/157 |
| 7,361,036 | B2 * | 4/2008 | Pittenger | H01R 13/62977 439/157 |
| 9,142,916 | B2 * | 9/2015 | Allgood | H01R 13/516 |
| 10,063,007 | B2 * | 8/2018 | Sugimoto | H01R 13/5812 |
| 2018/0083386 | A1 | 3/2018 | Suzuki et al. | |

FOREIGN PATENT DOCUMENTS

JP 2018-045930 3/2018

* cited by examiner

*Primary Examiner* — Edwin A. Leon
*Assistant Examiner* — Paul D Baillargeon
(74) *Attorney, Agent, or Firm* — Gerald E. Hespos; Michael J. Porco; Matthew T. Hespos

(57) ABSTRACT

A lever-type connector (10) includes wires (24), a housing (14), a cover (32), a lever (16) and a binding band (44). The lever (16) is mounted on the housing (14) for rotation between connection start and connection end positions. The cover (32) includes a wire draw-out portion (34) for bending the wires (24) pulled from the housing (14) and a wire fixing portion (36) for fixing the wires (24) to the wire draw-out portion (34). The wire fixing portion (36) includes a first side wall (38) on an inner side, a second side wall (40) on an outer side and a bottom wall (42) between the first and second side walls (38, 40). Contact of the lever (16) with the second side wall (40) stops rotation at the connection start position. The bottom wall (42) includes two band insertion holes (46) through which the binding band (44) is inserted.

4 Claims, 7 Drawing Sheets

LEVER-TYPE CONNECTOR

BACKGROUND

Field of the Invention

The disclosure relates to a lever-type connector.

Related Art

Japanese Unexamined Patent Publication No. 2018-045930 describes a lever-type connector including a connector housing, a wire cover and a lever. The lever is mounted on the connector housing for rotation between an initial position and a connection position. At the initial position, the lever is in a vertically upright posture. At the connection position, the lever is in such a posture that a front end is higher than a rear end.

The wire cover is mounted on the connector housing to cover the upper surface of the connector housing. The wire cover includes a draw-out portion for changing the orientation of wires introduced therein and drawing out the wires to outside. The draw-out portion of the wire cover is provided with a band mounting recess into which a binding band is mounted for fixing the wires. The band mounting recess project in a wire draw-out direction from the draw-out portion of the wire cover. The band mounting recess includes a first side wall located on an inner side of the wire cover and a second side wall located on an outer side of the wire cover.

The lever contacts the first side wall at the initial position to stop the rotation of the lever. Thus, the band mounting recess is in such a posture as to project from a side edge of the lever and has been a factor causing enlargement of the wire cover.

SUMMARY

This disclosure is directed to a lever-type connector with a wire, a housing, a cover, a lever and a binding band. The lever is mounted rotatably on the housing and is rotatable between a connection start position and a connection end position. The cover includes a wire draw-out portion for bending and drawing out the wire pulled out from the housing in a direction different from a pull-out direction of the wire and a wire fixing portion for fixing the wire to the wire draw-out portion. The wire fixing portion includes a first side wall located on an inner side of the cover, a second side wall located on an outer side of the cover and a bottom wall disposed between the first and second side walls. Rotation of the lever is stopped by contact of a part of the lever with the second side wall at the connection start position. The bottom wall includes band insertion holes through which the binding band is inserted.

If the lever is rotated from the connection end position to the connection start position, the rotation of the lever is stopped by the contact of the part of the lever with the second side wall. The wire fixing portion does not project from the lever at the connection start position. Thus, the cover can be reduced in size.

If a groove for winding the binding band is formed in the wire fixing portion, the bottom wall does not remain on an outer peripheral side of the groove, and the wire fixing portion is weak. If the binding band is wound on the outer periphery of the wire fixing portion without providing band insertion holes in the wire fixing portion, the lever contacts the binding band and complicates rotation of the lever to the connection start position. The wire fixing portion needs to be thinned to prevent contact of the lever and the binding band, and this thinning reduces the strength. Accordingly, if the wire fixing portion is provided with the band insertion holes, the bottom wall remains at least around the band insertion holes and the wire fixing portion need not be thinned. Thus, the wire fixing portion can be strong.

The lever of some embodiments includes two arms and a coupling that couples end parts of the arms. The contact of the side edges of the arms with both sides of the second side wall at the connection start position reliably stops rotation of the lever.

The coupling of the lever may include a tip side coupling that couples tips of the arms and a base end coupling portion that couples base ends of the arms. The tip side coupling is in a rear region of the housing at the connection end position. Since the tip side coupling is not in the lateral region of the housing, the interference of the tip side couplings can be avoided, for example, when two lever-type connectors are arranged bilaterally symmetrically and the levers are rotated to bring the tip side coupling portions closer to each other.

The lever may be rotatable to an accommodation position where the tip side coupling is in a lateral region of the housing. Since the tip side coupling is not in the rear region of the housing, the tip side coupling is not in the way when a terminal is inserted into the housing, and the terminal can be inserted into the housing with the lever assembled with the housing.

DETAILED DESCRIPTION

A specific example of the lever-type connector of this disclosure is described below with reference to the drawings. Note that the disclosure is not limited to these illustrations and is intended to be represented by claims and include all changes in the scope of claims and in the meaning and scope of equivalents.

Figure 1:
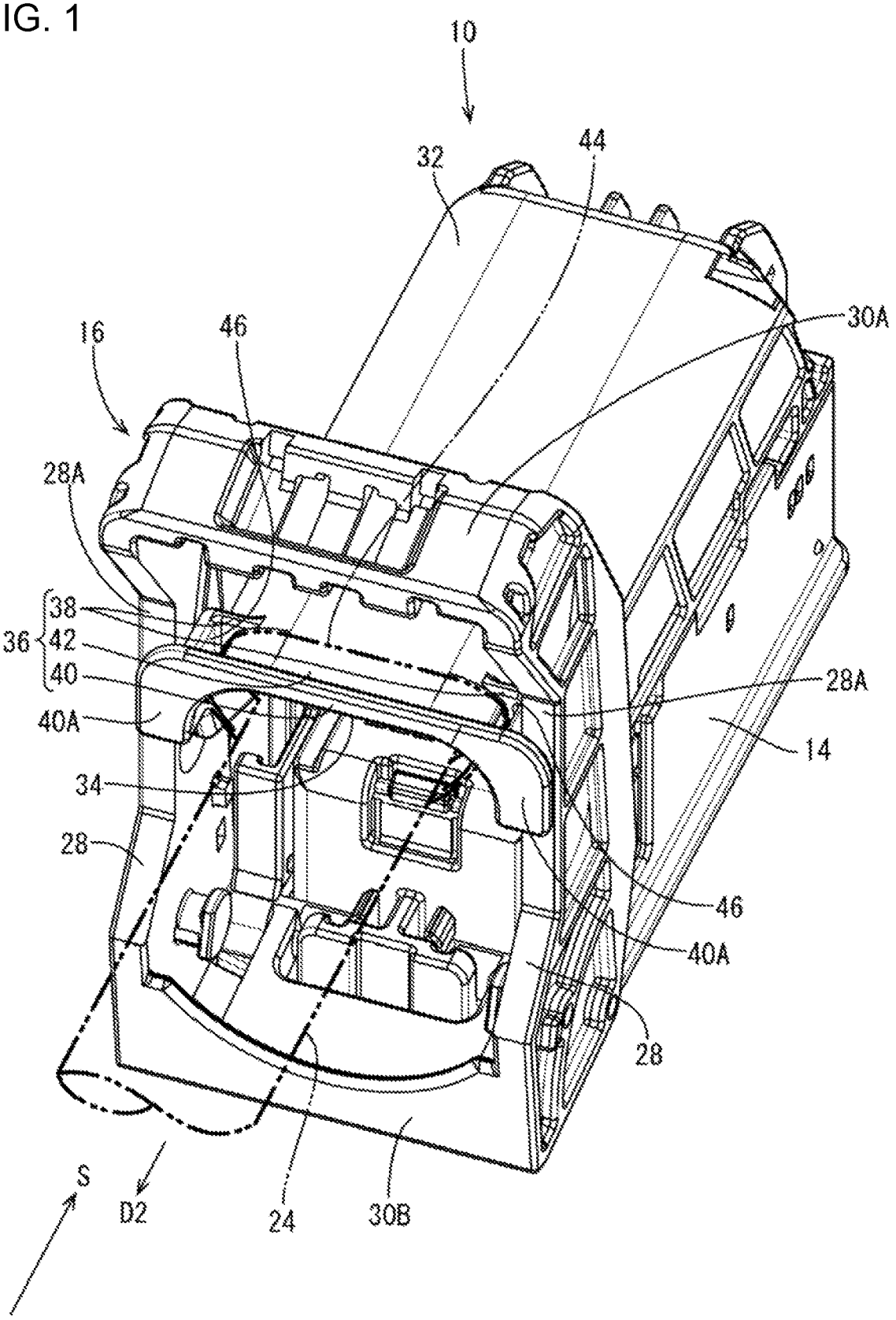
FIG. 1 is a rear perspective view of a lever-type connector in an embodiment showing a state where a lever is located at a connection start position.
Figure 2:
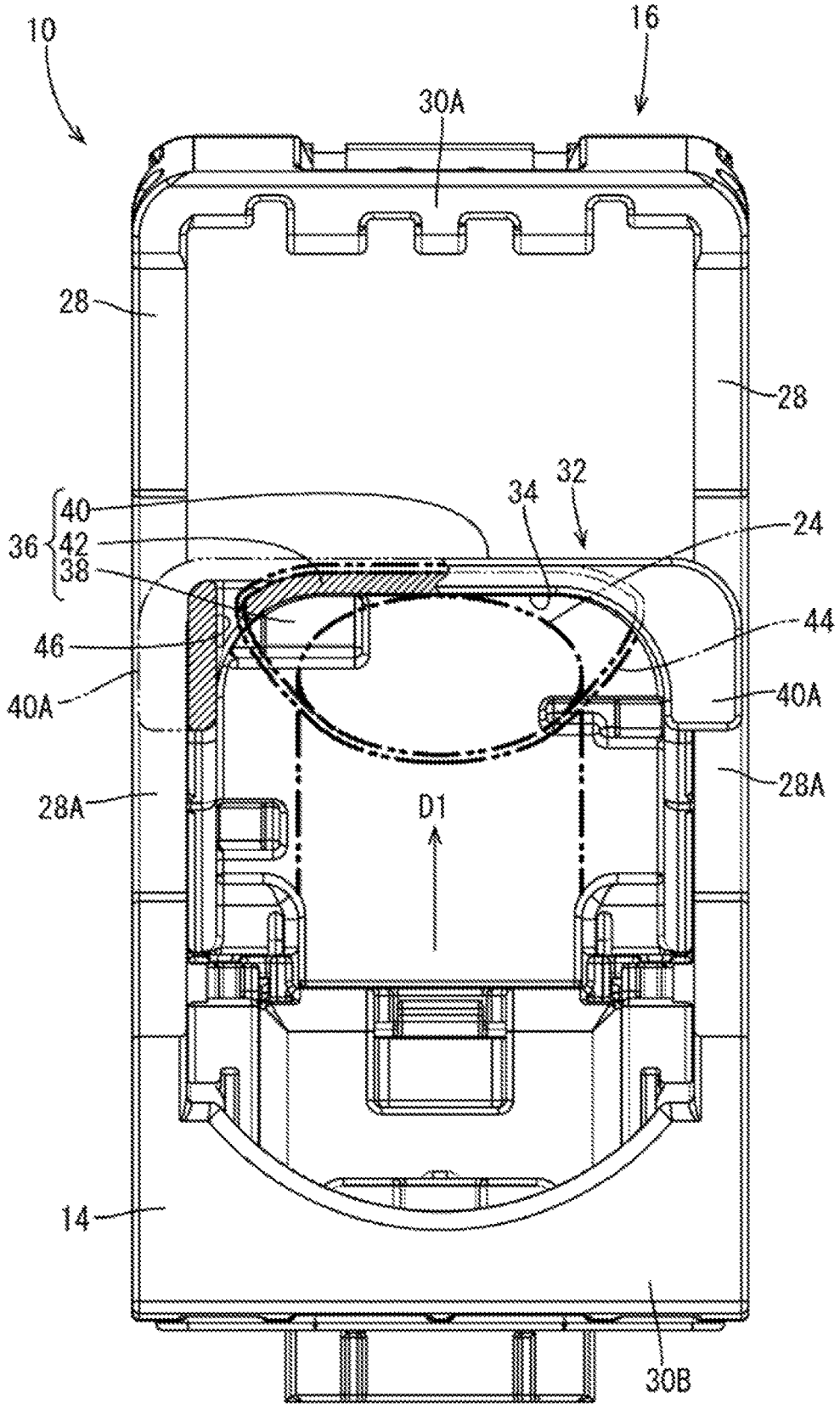
FIG. 2 is a back view of the connector housing in the state where the lever is located at the connection start position.
Figure 3:
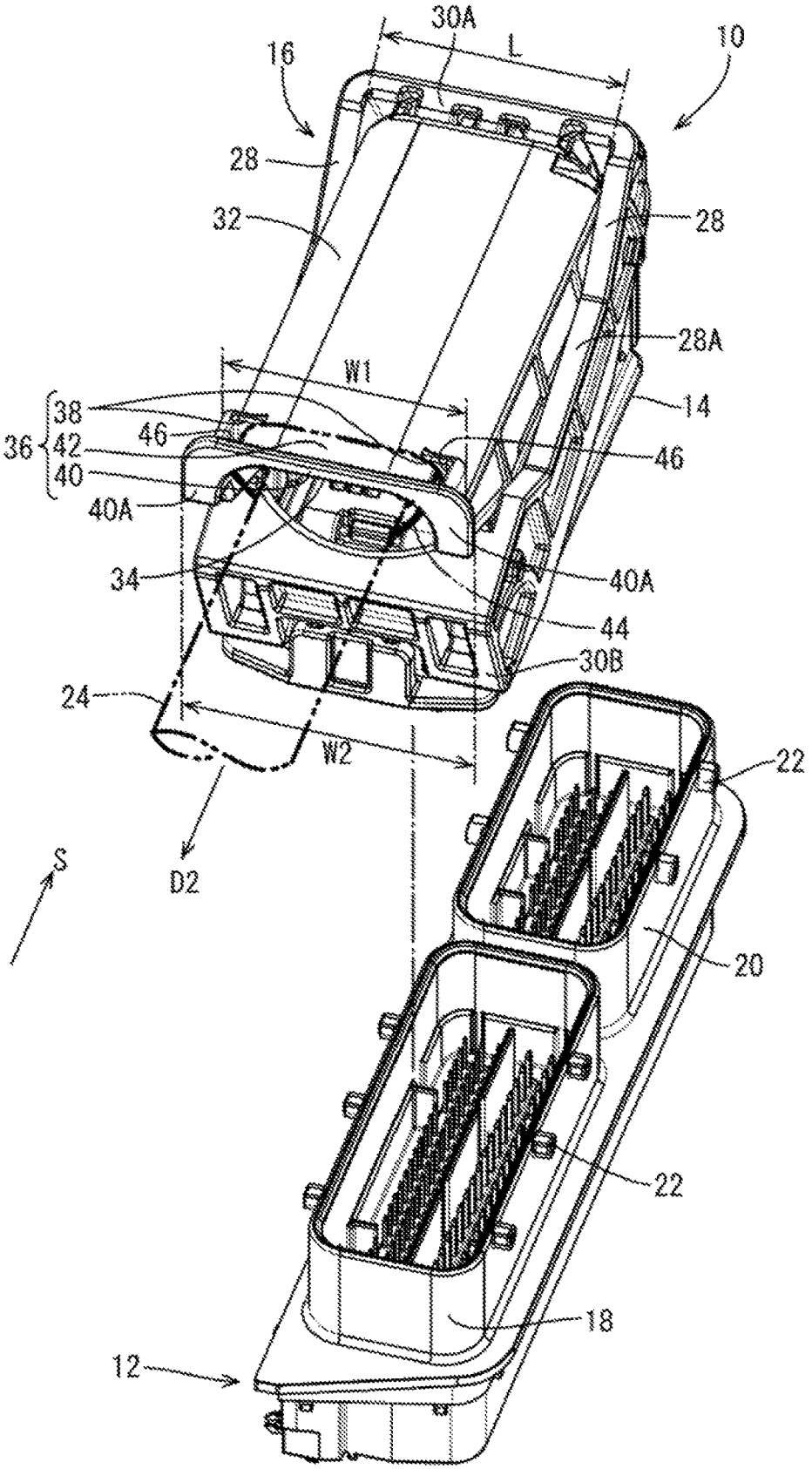
FIG. 3 is a rear perspective view of the lever-type connector in a state where the lever is located at a connection end position.

As shown in FIGS. 1 and 2, a lever-type connector 10 of this embodiment includes a housing 14 and a lever 16 to be mounted rotatably on the housing 14. As shown in FIG. 3, the housing 14 is connected to a mating housing 12. A connecting/separating direction of the housing 14 and the mating housing 12 is a front-rear direction and connection surfaces of the housings are referred to as front ends.

As shows in FIG. 3, the mating housing 12 includes a first receptacle 18 and a second receptacle 20. The housing 14 is fit into the first receptacle 18. Another housing (not shown)

different from the housing 14 is fit into the second receptacle 20. Projections 22 project outward on the outer peripheral surfaces of the first and second receptacles 18, 20.

As shown in FIG. 1, the housing 14 has a rectangular parallelepiped shape and cavities open in the front-rear direction are provided in the housing 14. Unillustrated terminals are accommodated respectively in the cavities, and wires 24 are connected respectively to the terminals. After being pulled out rearward (direction indicated by an arrow D1 of FIG. 2) from the cavities as shown in FIG. 2, the wires 24 are bent in a direction different from a pull-out direction and pulled out laterally (direction shown by an arrow D2 of FIG. 1). As shown in FIGS. 4 to 7, a region on a rear side of the housing 14 in the connecting direction is referred to as a rear region R1. Further, a region on a lateral side (direction indicated by an arrow S in FIGS. 4 to 7) of the housing 14 is referred to as a lateral region R2.

Plate-like sliders 26 are mounted on the side surfaces of the housing 14 slide laterally as the lever 16 is rotated. Only the slider 26 on a front side is shown in FIG. 4.

As shown in FIG. 1, the lever 16 includes two arms 28 and two couplings 30A, 30B. The arms 28 are mounted rotatably on both sides of the housing 14. The couplings 30A, 30B are composed of a tip side coupling 30A that couples tips of the arm portions 28 to each other and a base end coupling 30B that couples base ends of the arms 28 to each other.

Figure 4:
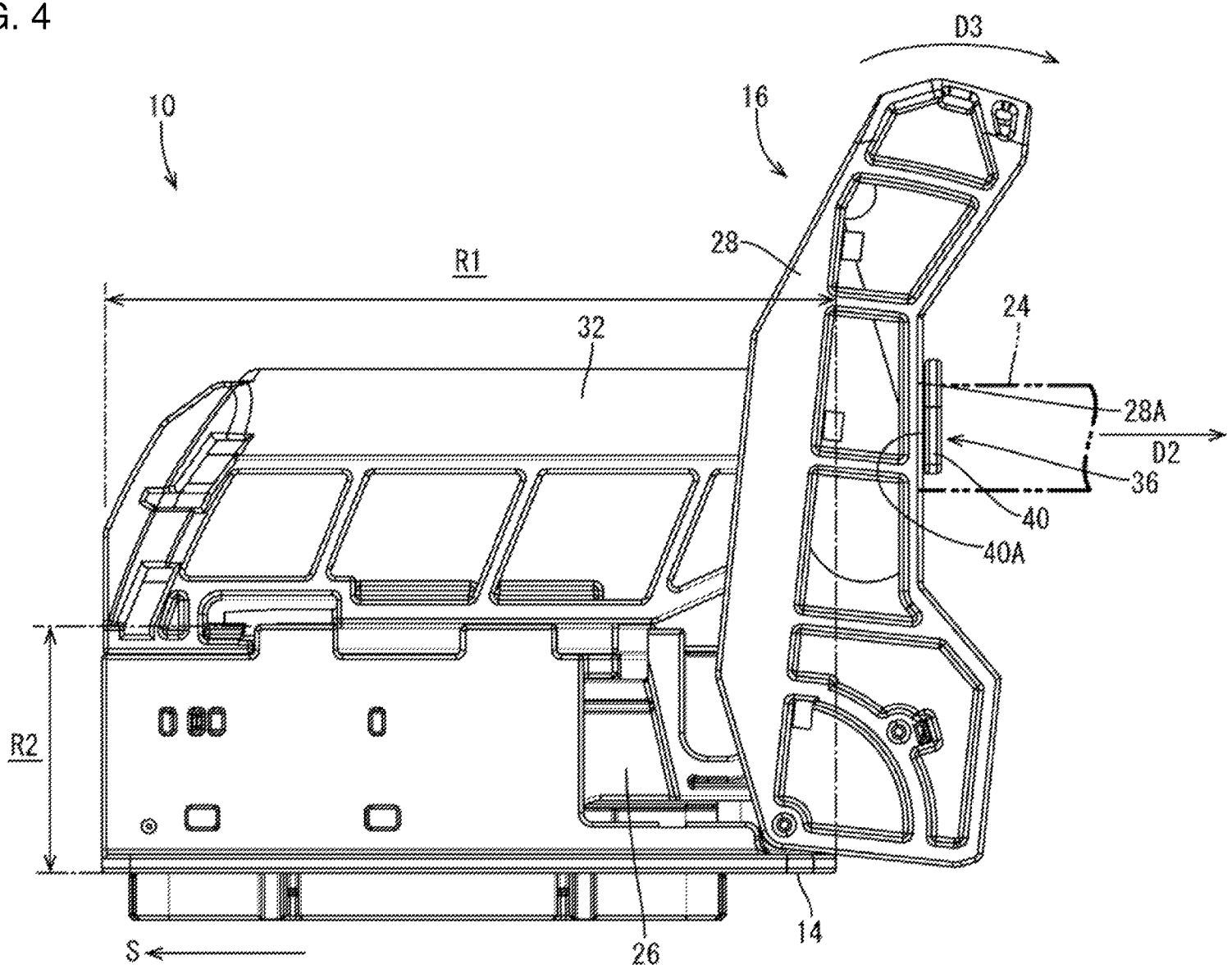
FIG. 4 is a side view of the lever-type connector in the state where the lever is at the connection start position.
Figure 5:
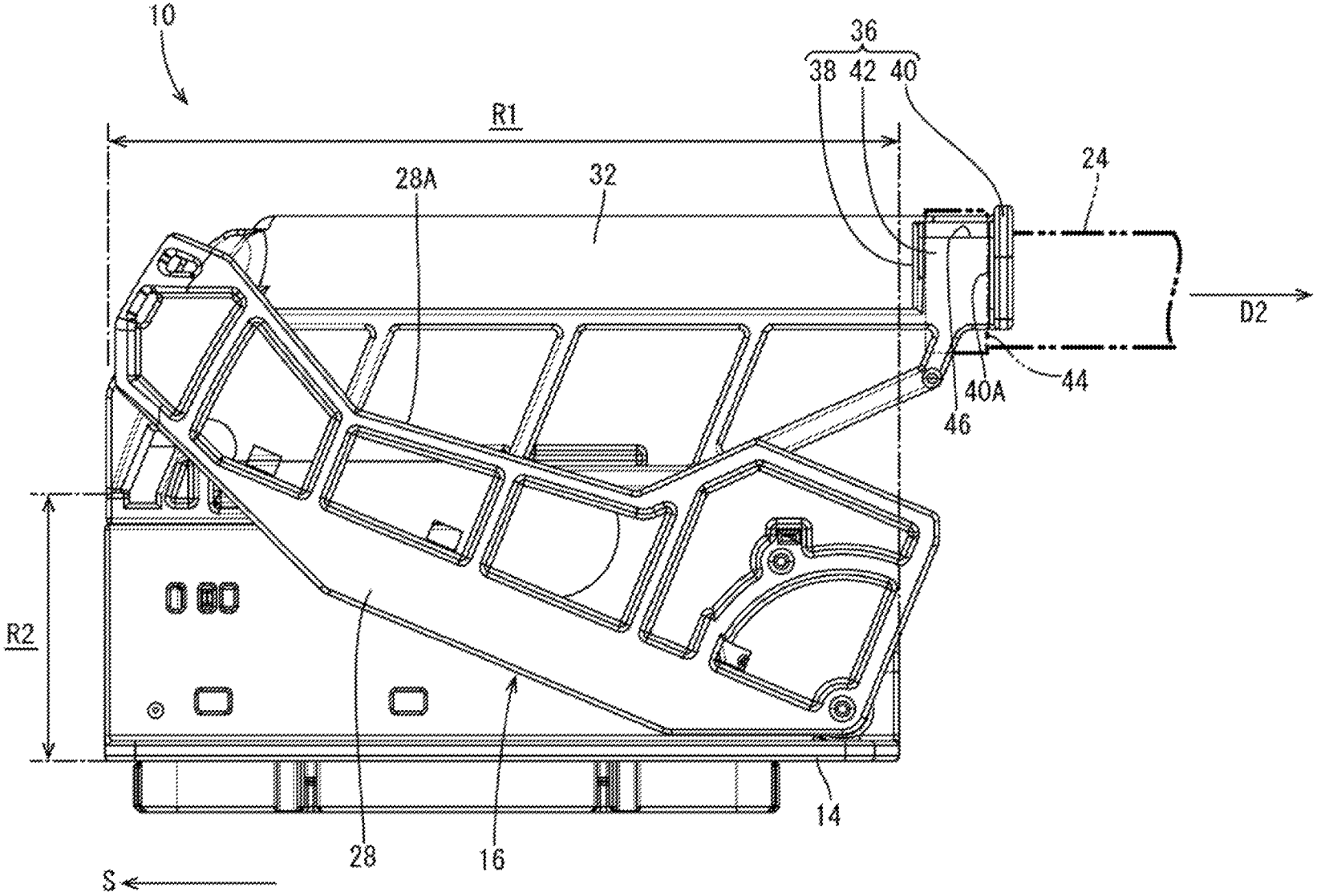
FIG. 5 is a side view of the lever-type connector in the state where the lever is located at the connection end position.

The lever 16 is rotatable between a connection start position, as shown in FIGS. 1 and 4, and a connection end position, as shown in FIGS. 3 and 5. Further, terminals (not shown) are inserted into the cavities of the housing 14 with the lever 16 located at an accommodation position shown in FIGS. 6 and 7 and with a cover 32 removed from the housing 14 (state shown in FIG. 7). Further, the lever 16 is shipped to a delivery destination while being located at the accommodation position.

The connection start position is the position of the lever 16 before the housing 14 is connected to the mating housing 12. The housing 14 is provided with a lock (not shown) for suppressing rotation of the lever 16 at the connection start position toward the connection end position before the housing 14 is accommodated into the mating housing 12. If the housing 14 is accommodated into the first receptacle 18 in the mating housing 12, the lock of the lever 16 is released to make the lever 16 rotatable toward the connection end position.

The connection end position is the position of the lever 16 after the housing 14 is connected to the mating housing 12. Here, guide grooves (not shown) into which the projections 22 on the mating housing 12 are inserted are provided in inner surfaces (not shown) of the sliders 26. The sliders 26 are displaced laterally when the lever 16 is rotated from the connection start position toward the connection end position while being accommodated in the first receptacle 18 of the mating housing 12. At this time, the housing 14 is guided into the first receptacle 18 while the projections 22 on the first receptacle 18 slide on inner walls of the guide grooves (not shown) in the sliders 26. A connecting operation of the housing 14 is completed when the lever 16 reaches the connection end position.

As shown in FIG. 5, the tip side coupling 30A of the lever 16 is not in the lateral region R2, but in the rear region R1 of the housing 14 at the connection end position. In this way, the mating housing 12 can be reduced in size as compared to a configuration in which a tip side coupling of a lever is in a lateral region at a connection end position. Specifically, if the tip side coupling of the lever is disposed not in the rear region R1, but in the lateral region R2 at the connection end position, a distance between first and second receptacles needs to be sufficiently long so that the tip side coupling of the lever does not interfere with another lever-type connector (not shown) fit in the second receptacle. Thus, the mating housing is enlarged. Therefore, a short distance can be set between the first and second receptacles 18, 20 and the mating housing 12 can be reduced in size by employing the configuration of this embodiment.

Figure 6:
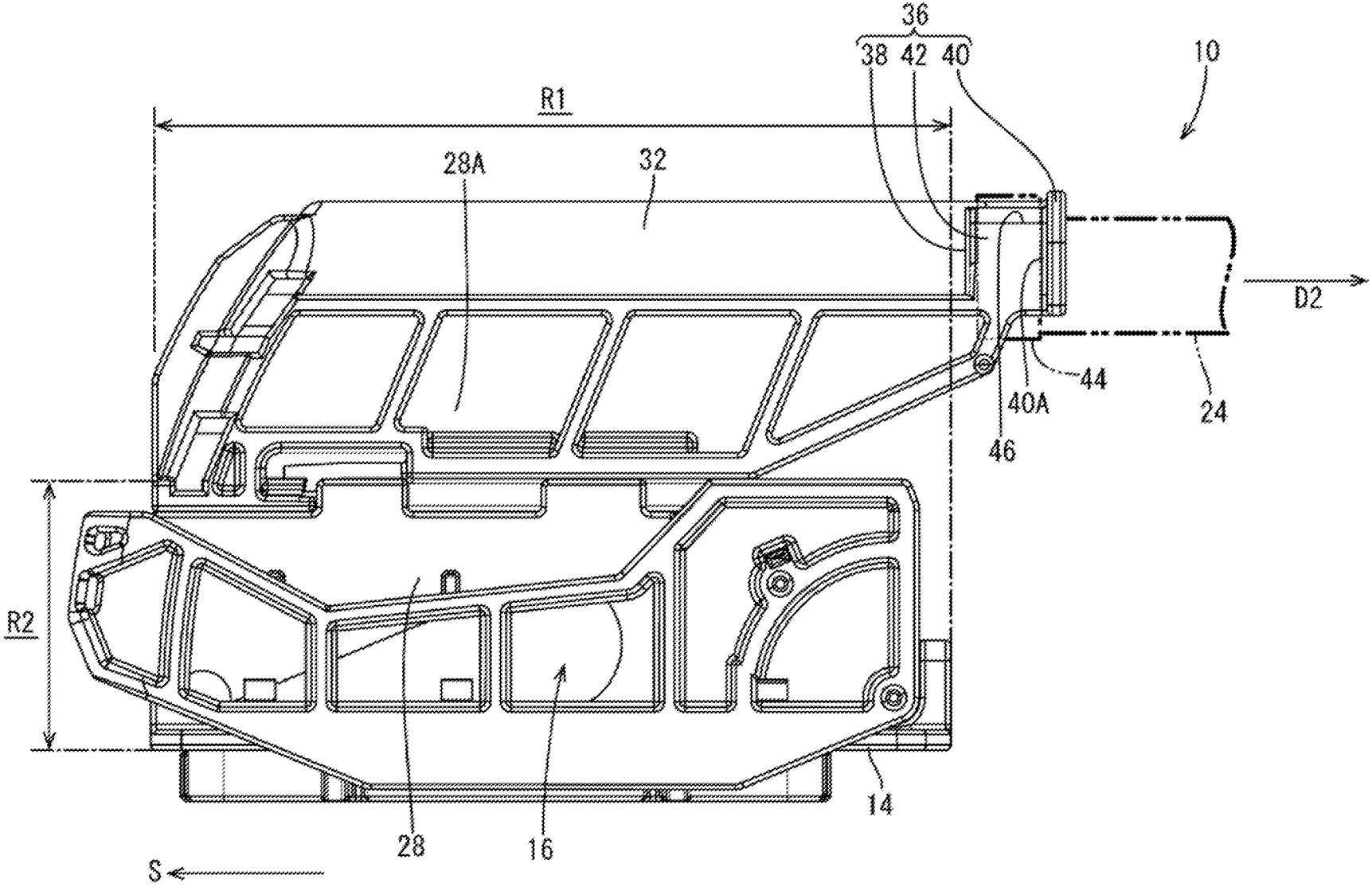
FIG. 6 is a side view of the lever-type connector in a state where the lever is located at an accommodation position.
Figure 7:
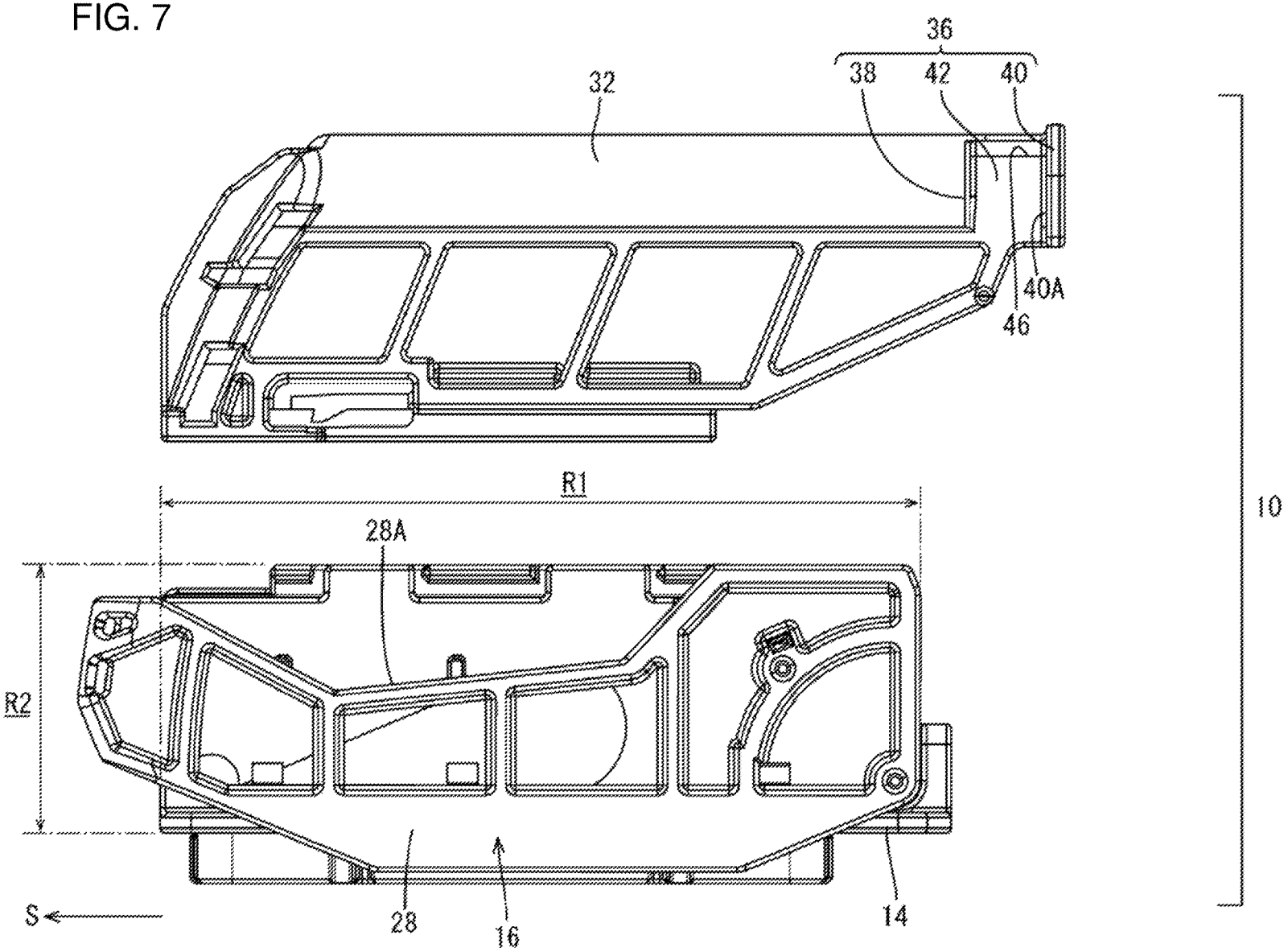
FIG. 7 is a side view of the lever-type connector in a state where a cover is removed at the accommodation position.

As shown in FIGS. 6 and 7, the tip side coupling 30A of the lever 16 is disposed not in the rear region R1, but in the lateral region R2 with the lever 16 located at the accommodation position. This suppresses the interference of the terminals with the tip side coupling 30A when the terminals are inserted into the cavities from behind with the cover 32 removed from the housing 14 (state shown in FIG. 7). Thus, the terminals can be inserted into the cavities of the housing 14 with the lever 16 assembled with the housing 14.

As shown in FIG. 1, the cover 32 is mounted on the housing 14 to cover the housing 14 from behind. A wire draw-out portion 34 is provided in a rear part of the cover 32. The wire draw-out portion 34 is facing the housing 14 while being open laterally. The wires 24 are drawn out to the outside of the cover 32 from the wire draw-out portion 34.

As shown in FIGS. 1 and 3, a wire fixing portion 36 for fixing the wires 24 to the wire draw-out portion 34 is provided on an outer peripheral side of the wire draw-out portion 34.

As shown in FIG. 5, the wire fixing portion 36 includes a first side wall 38, a second side wall 40 and a bottom wall 42. The second side wall 40 is located on a lateral side (outer side) of the cover 32 and the first side wall 38 is located on an inner side of the cover 32. The bottom wall 42 is disposed between the first side wall 38 circumferentially provided on the outer surface of the cover 32 and the second side wall 40.

As shown in FIGS. 1 and 3, two band insertion holes 46 through which a binding band 44 is inserted are provided to be open on both sides of the bottom wall 42. The wires 24 are fixed to the wire fixing portion 36 by being bundled by the banding band 44 inserted through the band insertion holes 46. By providing such band insertion holes 46, a strength reduction of the wire fixing portion 36 can be suppressed as compared to a configuration in which a groove for winding a binding band is formed in a wire fixing portion. Specifically, since a bottom wall does not remain on an outer peripheral side of the groove if the groove for winding the binding band is formed in the wire fixing portion, this becomes one of factors causing a strength reduction of the wire fixing portion. On the other hand, if the wire fixing portion 36 is provided with the band insertion holes 46 as in this embodiment, the bottom wall 42 remains at least around the band insertion holes 46 and strengthens the wire fixing portion 36.

As shown in FIG. 3, a width W1 of the first side wall 38 is shorter than a length L between the arms 28 of the lever 16, and a width W2 of the second side wall 40 is longer than the length L between the arms 28. In this way, if the lever 16 is rotated in the direction indicated by the arrow D3 in FIG. 4 and hence opposite to a rotating direction of the lever 16 from the connection start position toward the connection end position, side edges 28A of the arms 28 contact both sides 40A of the second side wall 40 without contacting the first side wall 38. Thus, rotation of the lever 16 is stopped reliably by the second side wall 40. Further, the cover 32 can be reduced in size by a length of the wire fixing portion 36 in the direction D2 as compared to a configuration in which rotation of a lever is stopped by a first side wall.

OTHER EMBODIMENTS

The tip side coupling 30A of the lever 16 is disposed in the lateral region R2 on a left side of the housing 14 at the accommodation position, as shown in FIGS. 6 and 7. However, the tip side coupling portion 30A may be disposed, for example, in a lateral region on a right side.

The lever 16 may have only one arm.

The wire fixing portion 36 does not project farther laterally than the lateral end of the housing 14 in the above embodiment. However, the wire fixing portion 36 may not project laterally. For example, the cover may be reduced in size by providing the second side wall on the lateral end of the housing 14.

LIST OF REFERENCE SIGNS

10: lever-type connector
12: mating housing
14: housing
16: lever
18: first receptacle
20: second receptacle
22: projection
24: wire
26: slider
28: arm
28A: side edge
30A: tip side coupling portion
30B: base end side coupling portion
32: cover
34: wire draw-out portion
36: wire fixing portion
38: first side wall
40: second side wall
40A: side portion
42: bottom wall
44: binding band
46: band insertion hole
L: length
R1: rear region
R2: lateral region
W1, W2: width

What is claimed is:

1. A lever-type connector with a wire, a housing, a cover, a lever and a binding band, wherein:

the lever is mounted rotatably on the housing and is rotatable between a connection start position and a connection end position, the cover includes a wire draw-out portion for bending and drawing out the wire pulled out from the housing in a direction different from a pull-out direction of the wire and a wire fixing portion for fixing the wire to the wire draw-out portion, the wire fixing portion includes a first side wall located on an inner side of the cover, a second side wall located on an outer side of the cover and a bottom wall disposed between the first side wall and the second side wall, rotation of the lever is stopped by contact of a part of the lever with the second side wall at the connection start position, and the bottom wall includes two band insertion holes through which the binding band is inserted.

2. The lever-type connector of claim 1, wherein:

the lever includes two arms and a coupling that couples end parts of the arms, and side edges of the arms contact both sides of the second side wall at the connection start position.

3. The lever-type connector of claim 2, wherein the coupling of the lever includes a tip side coupling that couples tip parts of the arms and a base end coupling that couples base ends of the arms, and the tip side coupling is disposed in a rear region of the housing at the connection end position.

4. The lever-type connector of claim 3, wherein the lever is rotatable to an accommodation position where the tip side coupling is disposed in the lateral region of the housing.

* * * * *